US008371379B2

(12) United States Patent
Parkinson

(10) Patent No.: US 8,371,379 B2
(45) Date of Patent: Feb. 12, 2013

(54) PUMPING STATION CONFIGURATION METHOD AND APPARATUS

(76) Inventor: Craig Stephen Parkinson, Runnaway Bay (AU)

( * ) Notice: Subject to any disclaimer, the term of this patent is extended or adjusted under 35 U.S.C. 154(b) by 656 days.

(21) Appl. No.: 12/275,313

(22) Filed: Nov. 21, 2008

(65) Prior Publication Data

US 2009/0093915 A1 Apr. 9, 2009

(30) Foreign Application Priority Data

May 24, 2006 (AU) ..... 2006902806
May 24, 2007 (WO) ..... PCT/AU2007/000713

(51) Int. Cl.
*E21B 43/12* (2006.01)

(52) U.S. Cl. ..... 166/250.01; 166/53; 166/66

(58) Field of Classification Search ..... 73/152.61; 166/250.01, 53, 66; 700/282
See application file for complete search history.

(56) References Cited

U.S. PATENT DOCUMENTS 4,987,913 A * 1/1991 Kodate et al. ..... 137/1
5,198,987 A * 3/1993 Shindo et al. ..... 716/129
5,812,394 A 9/1998 Lewis et al.
6,178,393 B1 * 1/2001 Irvin ..... 703/10
6,203,282 B1 * 3/2001 Morin ..... 417/44.1
2003/0216879 A1 * 11/2003 Hashemian ..... 702/95
2005/0123408 A1 * 6/2005 Koehl ..... 417/53
2006/0213659 A1 * 9/2006 McCoy ..... 166/250.01

FOREIGN PATENT DOCUMENTS

WO WO 2007/134401 A1 11/2007

OTHER PUBLICATIONS

International Search Report, Applicant: MultiTrode Pty Ltd et al., International Application No. PCT/AU2007/000713, filed May 24, 2007, mailing date Jul. 25, 2007, pp. 3.
PCT Written Opinion of the International Searching Authority, Applicant: MultiTrode Pty Ltd et al., International Application No. PCT/AU2007/000713, filed May 24, 2007, mailing date Jul. 25, 2007, pp. 3.

* cited by examiner

*Primary Examiner* — Cathleen Hutchins

(57) ABSTRACT

In accordance with some embodiments, a pumping station controller (14) is provided for monitoring pumping station hardware such as a well level sensor (8) and pumps (10*a*, . . . , 10*n*). A user interface (12) enables a user to input data to the controller (14) for controlling the operation of the pumps (10) based on the sensed liquid level. Pumping hardware configurations vary from site to site so that wiring the hardware to the controller may be confusing for the user. To address this problem the controller may comprise a software product (20). The software product may comprise instructions for processor (19) to determine a suitable wiring configuration between the controller (14) and the pumping station hardware, based upon user entered parameters identifying the pumping station hardware to be used.

16 Claims, 9 Drawing Sheets

PUMPING STATION CONFIGURATION METHOD AND APPARATUS

TECHNICAL FIELD

The present invention generally relates to the configuration of pumping stations. The present invention has particular, although not exclusive application to pumping stations for emptying sewage wells or for filling water wells.

BACKGROUND

The reference to any prior art in this specification is not, and should not be taken as an acknowledgement or any form of suggestion that the prior art forms part of the common general knowledge.

Pumping stations 2 for emptying sewage wells (FIG. 1*a*) and filling water wells (FIG. 1*b*) are known. These pumping stations 2 typically include a well 4 in which liquid 6 is located, a level sensor 8 for sensing the liquid level in the well 4, a pair of pumps 10 for pumping liquid into or out of the well 4 as required, and a controller (not shown) in communication with sensor 8 for controlling the operation of the pumps 10 based on the sensed liquid level in the well 4. FIG. 1 shows various level trigger-points along the level sensor 8 in the form of electrodes. The controller independently activates or de-activates each pump 10 in response to it sensing the liquid level via the electrodes.

The controller may take the form of a programmable logic controller (PLC) coupled to pumping station hardware (e.g. level sensors 8 and pumps 10). Since the hardware is prone to variation from station to station, it is often wired to the PLC in a different manner at each pumping station. The PLC can then be programmed to suit the particular hardware and wiring configuration. The variation of hardware configurations between respective pumping stations can complicate the reconfiguration of the pumping station hardware at a later stage, particularly in the event of documentation relating to the existing pumping station configuration being incomplete or misplaced.

Embodiments of the present invention may provide a systematic method for facilitating coupling of a controller to associated pumping station hardware.

SUMMARY

According to one embodiment of the present invention, there is provided a method for determining a coupling configuration between a pumping station controller and pumping station hardware, the method comprising:

- receiving in a processor at least one parameter relating to the pumping station hardware; and
- determining, with the processor, a coupling configuration between the pumping station controller and the pumping station hardware using the at least one parameter.

The method may further comprise coupling the pumping station controller to the pumping station hardware in accordance with the determined coupling configuration. The coupling may involve wiring input/output (I/O) ports of the controller to the hardware.

The processor may define a database comprising a plurality of wiring diagram records, each wiring diagram record comprising:

- at least one unique record parameter relating to possible pumping station hardware; and

- a wiring diagram identifier for identifying a wiring diagram comprising the coupling configuration between the pumping station controller and the possible pumping station hardware.

The determining may comprise corresponding the at least one received parameter with the at least one record parameter and then displaying the wiring diagram identifier of the corresponding record.

Prior to the receiving, the method may further involve inputting or selecting the at least one parameter using a user interface which is coupled to the processor.

In one embodiment, the processor comprises the controller.

The method may further comprise configuring one or more input/output (I/O) ports of the controller in accordance with the at least one parameter. The configuring the ports may comprise configuring a software interface linking control routines for controlling the hardware with the I/O ports.

The hardware may comprise any one or more of the following devices: a pump, a variable speed drive pump, a digital liquid level sensor, an analogue liquid level sensor, a leakage sensor of the pump, a thermal sensor of the pump, a remote terminal unit (RTU), communications devices comprising a modem or a radio transceiver, and digital or analogue sensors comprising, for example, pulsed rain gauges and liquid flow rate sensors.

The at least one parameter may comprise any one or more of the following group: the number of pumps of the pumping station, the type of liquid level sensor to be used in sensing the liquid level of the pumping station, and the type of leakage sensor of each pump.

According to one embodiment of the present invention, there is provided a method for determining a coupling configuration between a pumping station controller and pumping station hardware, the method comprising:

- determining, with a processor, a coupling configuration between the pumping station controller and the pumping station hardware using at least one parameter relating to the pumping station hardware.

According to a further embodiment of the present invention, there is provided a system for performing any one or more of the preceding methods.

According to a further embodiment of the present invention, there is provided a computer usable medium, such as a magnetic or optical disk or solid state memory, containing computer readable instructions for execution by the processor to thereby perform any one or more of the preceding methods.

According to a further embodiment of the present invention, there is provided the computational device arranged to perform any one or more of the preceding methods.

According to a further embodiment of the invention there is provided a pump controller for monitoring pumping hardware of a well, comprising:

- a user interface having a display screen and user input keys;
- a processor in communication with the user interface and in communication with ports for connection to the pumping hardware; and
- a memory in communication with the processor;

wherein the memory contains a software product comprising:

- a control software block comprising control routines for monitoring and controlling the pumping hardware;
- a configuration software block arranged to variably interface the control routines to the communication ports in response to user input parameters specifying the pumping hardware.

The pump controller may comprise connection points corresponding to the communication ports for wiring to the pumping hardware, wherein the software product further comprises instructions to display information to assist a user to connect the hardware to connection points in response to the user input parameters.

BRIEF DESCRIPTION OF THE DRAWINGS

Features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF EMBODIMENTS

Figure 1A:
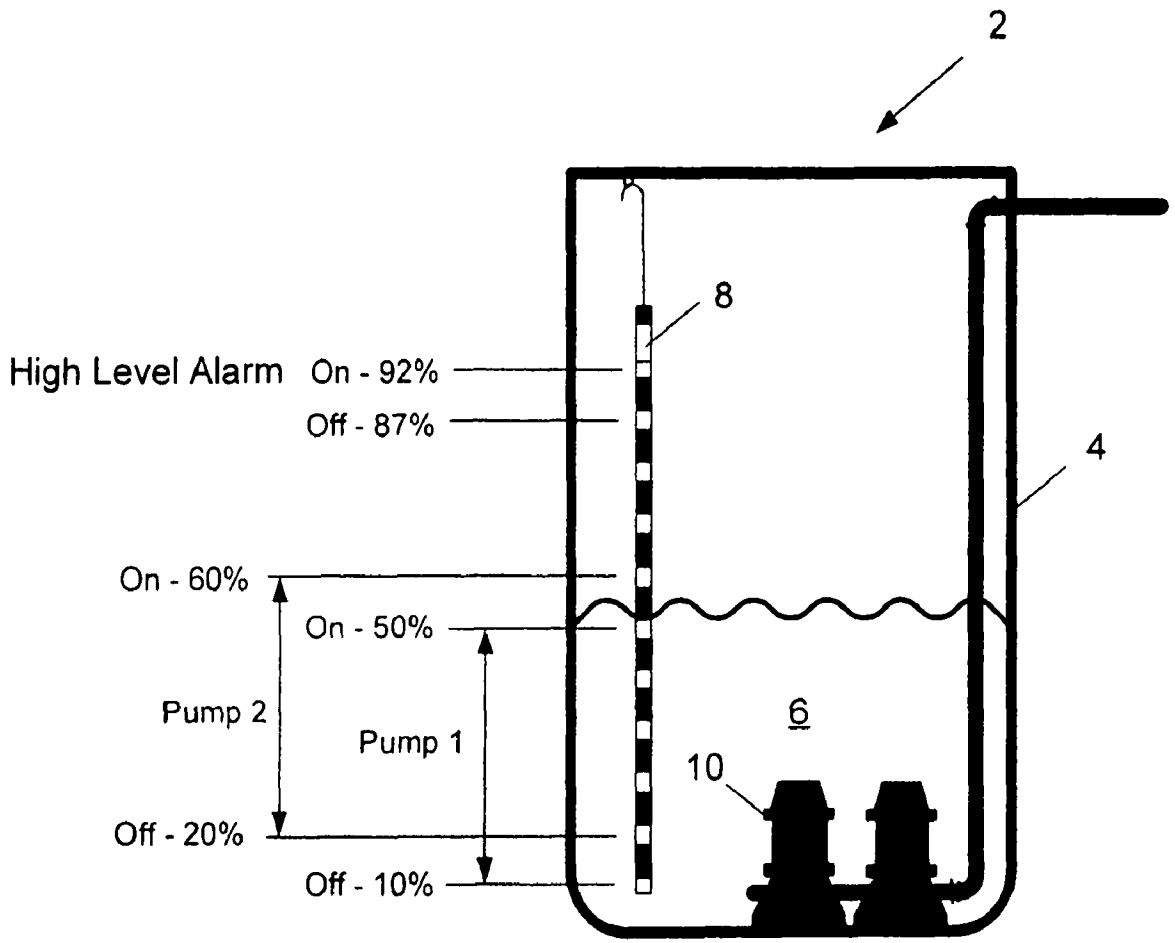
Fig. 1A PRIOR ART
FIG. 1*a* is a schematic diagram of a pumping station for emptying a sewage well.
Figure 1B:
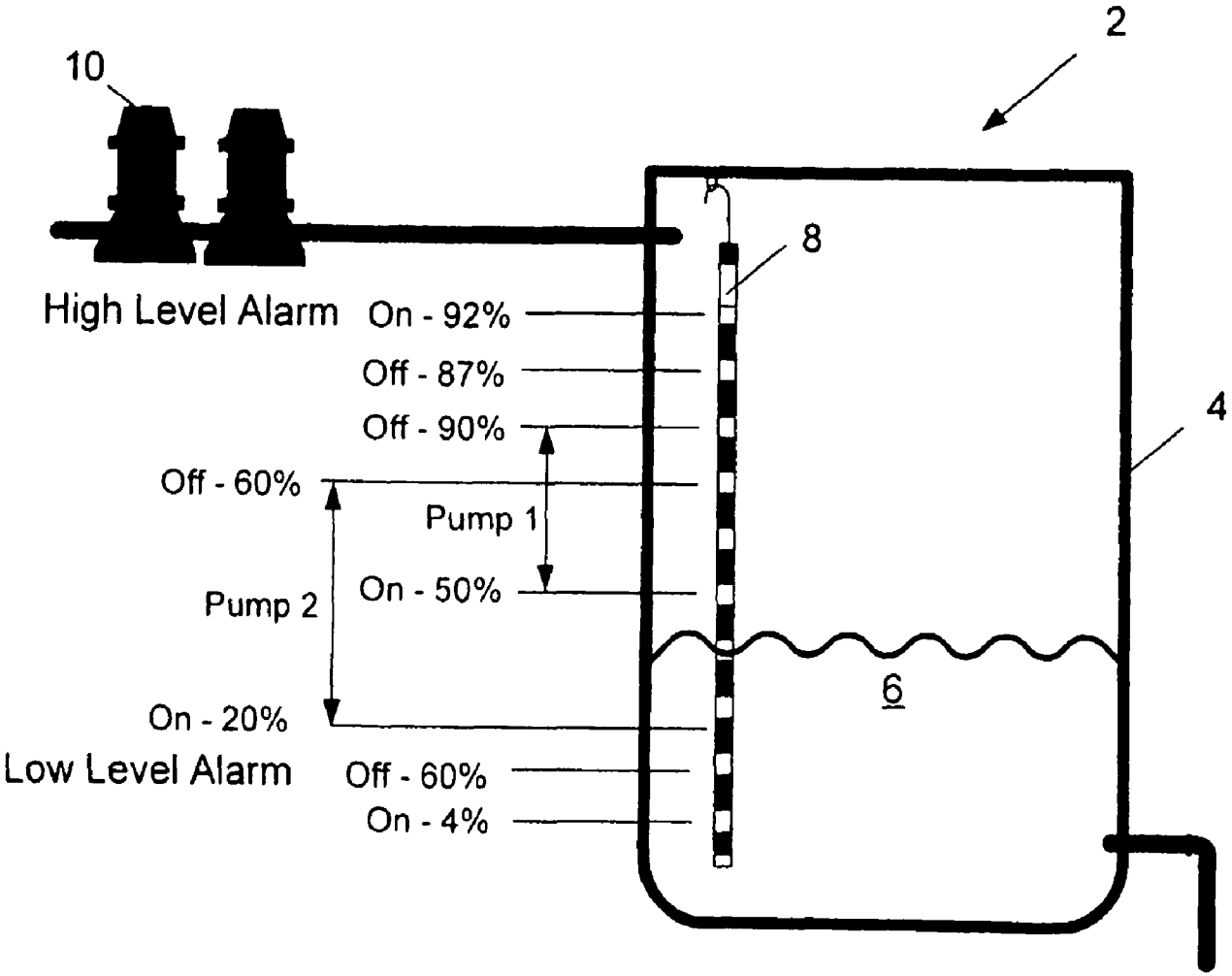
Fig. 1B PRIOR ART
FIG. 1*b* is a schematic diagram of a pumping station for filling a water well.
Figure 2A:
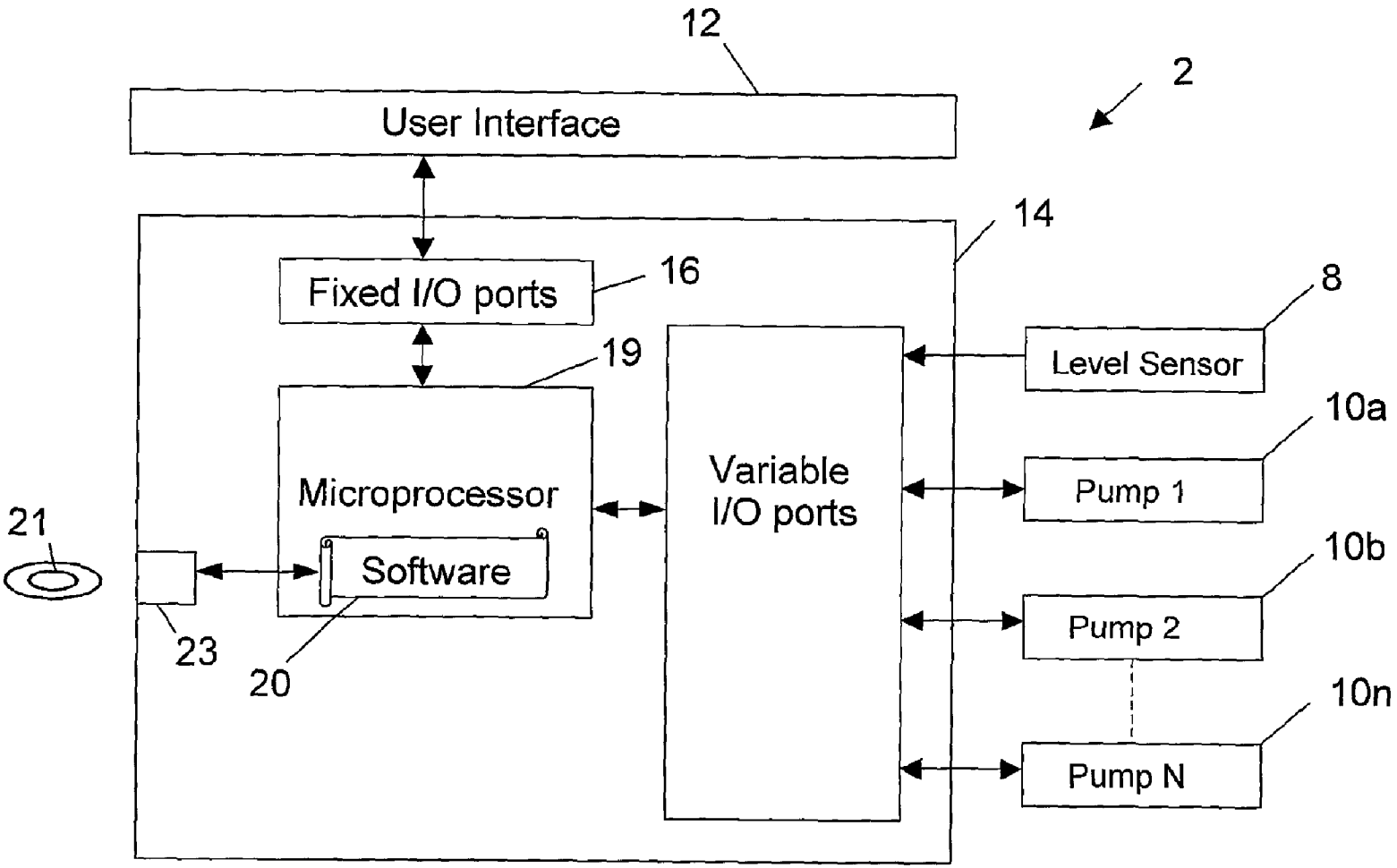
FIG. 2*a* is a block diagram of a pumping station in accordance with an embodiment of the present invention.

An embodiment of the present invention will now be described with reference to pumping station 2 as shown in FIG. 2*a*. The pumping station 2 includes a level sensor 8 for sensing the liquid level in a well, a pair of pumps 10*a*, 10*b* (e.g. variable speed drive (VFD) pumps) for pumping liquid into or out of the well as required, and a logic controller 14 for controlling the operation of the pumps 10 based on the sensed liquid level in the well. A user interface 12 is provided to enable a user to input data to the controller 14 and review controller data relating to the operation of the pumping station 2 on a display. The user interface 12 is fixedly wired to fixed input/output (I/O) ports 16 of the controller 14 which, in turn, are interfaced using suitable circuitry to a microprocessor 19 that executes a software product 20.

The level sensor 8 and pumps 10 are wired to variable I/O ports 18 of the controller 14 which, in turn, are interfaced using suitable circuitry to the microprocessor 19. The wiring configuration between the variable I/O ports 18 and the hardware is prone to variation depending upon the type of hardware (e.g. level sensor 8, pumps 10, etc.) used in the pumping station 2. The software product 20 includes instructions for processor 19 to perform a method for determining a suitable wiring configuration between the controller 14 and the pumping station hardware, based upon the pumping station hardware to be used. Software product 20 is typically provided as firmware in an integrated circuit memory device or as a magnetic or optical disc 21 which microprocessor 19 can access by means of disc drive 23.

Figure 2B:
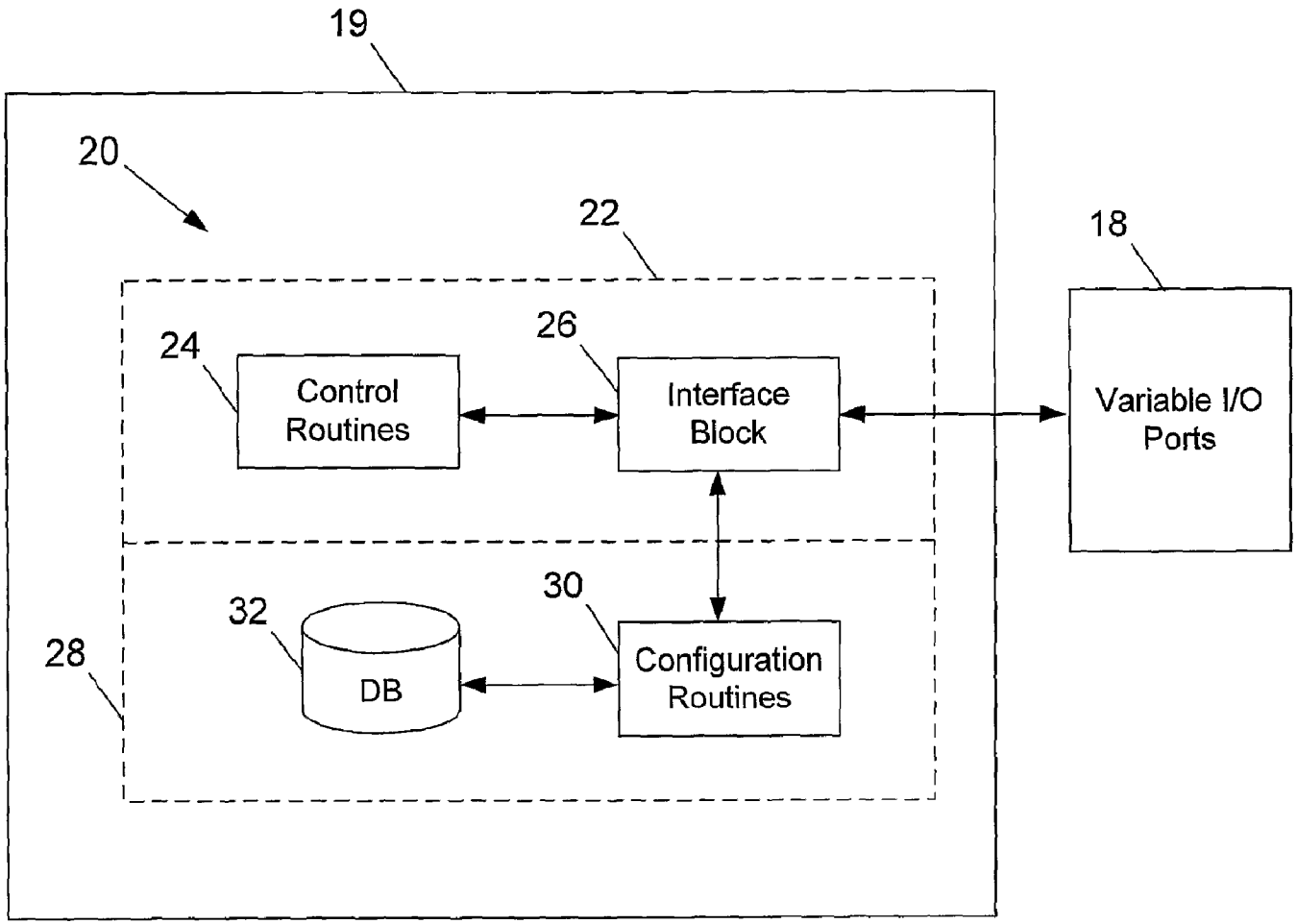
FIG. 2*b* is a functional block diagram of a software product executed by a microprocessor of the pumping station of FIG. 2*a;*

FIG. 2*b* schematically depicts the functional software modules of the software product 20 including a control software block 22 for controlling the operation of the pumps 10, and a configuration software block 28 for facilitating configuration of the coupling of the pump station hardware to the controller 14, when setting up or reconfiguring the pumping station 2.

The control software block 22 includes a fixed set of control routines 24 which control the operation of the pumps 10 based upon feedback provided from the level sensor 8 or any other sensing devices. As the hardware and the wiring configuration of the hardware to the controller 14 is subject to variation from pumping station to pumping station, the control software block 22 includes a software interface block 26 which can be configured so that the control routines 24 are linked to the required I/O ports 18. That is, the control routines 24 and variable I/O ports 18 remain static whereas the interface block 26 can be configured to suit the particular hardware wiring arrangement using the configuration software block 28.

The configuration software block 28 includes configuration routines 30 for configuring the interface block 26 as previously described. The configuration routines 30 further perform the method of determining a suitable wiring diagram to be used when coupling the controller 14 to the pumping station hardware, based upon one or more hardware parameters received from the user via the user interface 12. The controller 14 accesses a database 32 which is utilized by the configuration routines 30 when determining a suitable wiring diagram.

Figure 3:
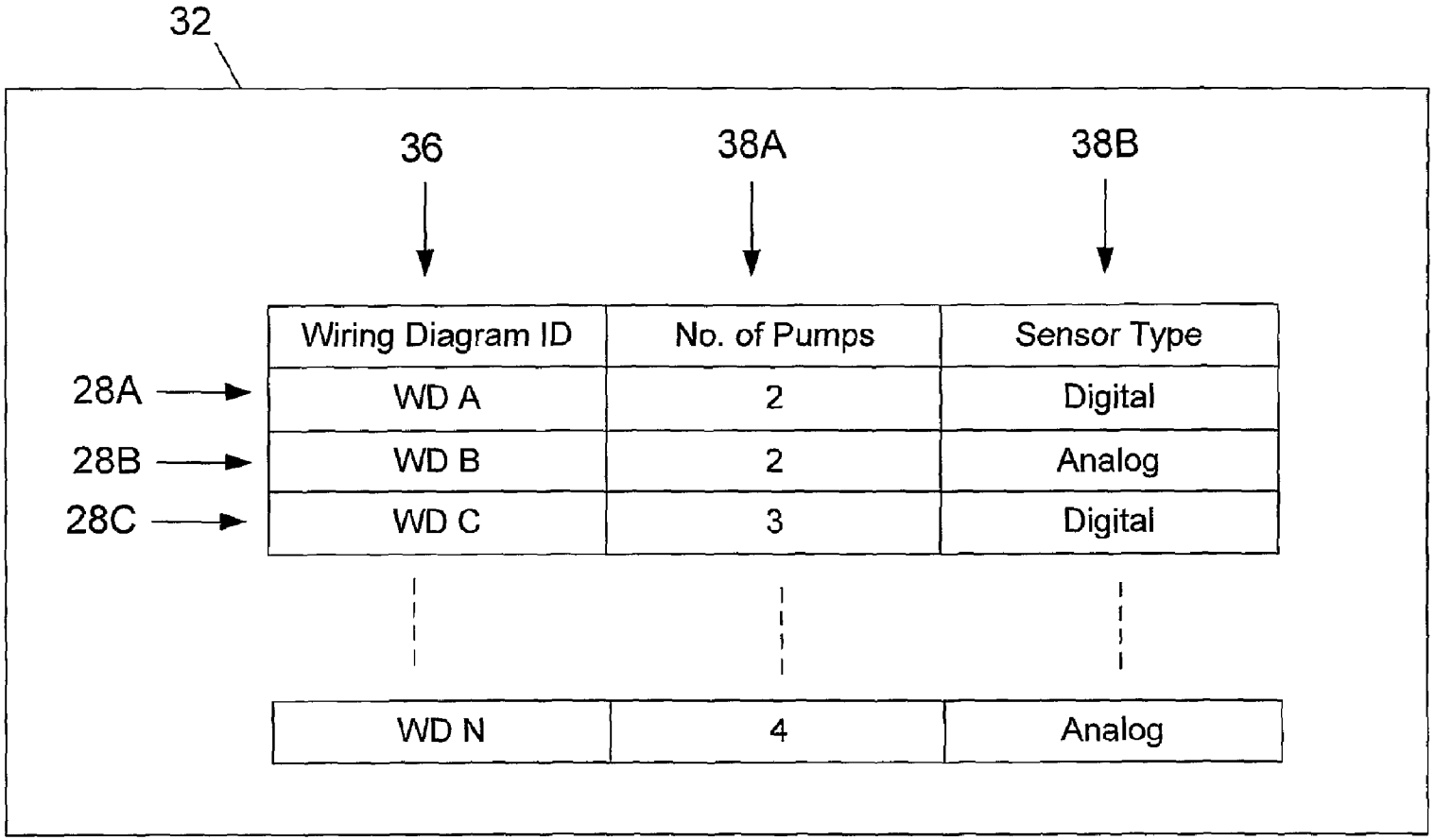
FIG. 3 is a schematic diagram of a database of the software product of FIG. 2*b;*

Turning to FIG. 3, the database 32 includes a plurality of wiring diagram records 28 (as depicted as a row of data). Each wiring diagram record 28 includes a unique combination of hardware parameters 38 each relating to possible pumping station hardware. The hardware parameters 38 may include the number of pumps of the pumping station 38*a*, the type of liquid level sensor to be used in sensing the liquid level of the pumping station 38*b*, and the type of leakage sensor of each pump (not shown). Each wiring diagram further includes a wiring diagram identifier 36 (e.g. WD A) which is indicative of a wiring diagram 40 (FIG. 6) that shows a wiring configuration between the controller 14 and the possible pumping station hardware (e.g. level sensor 8, pump 10, etc.).

Figure 4:
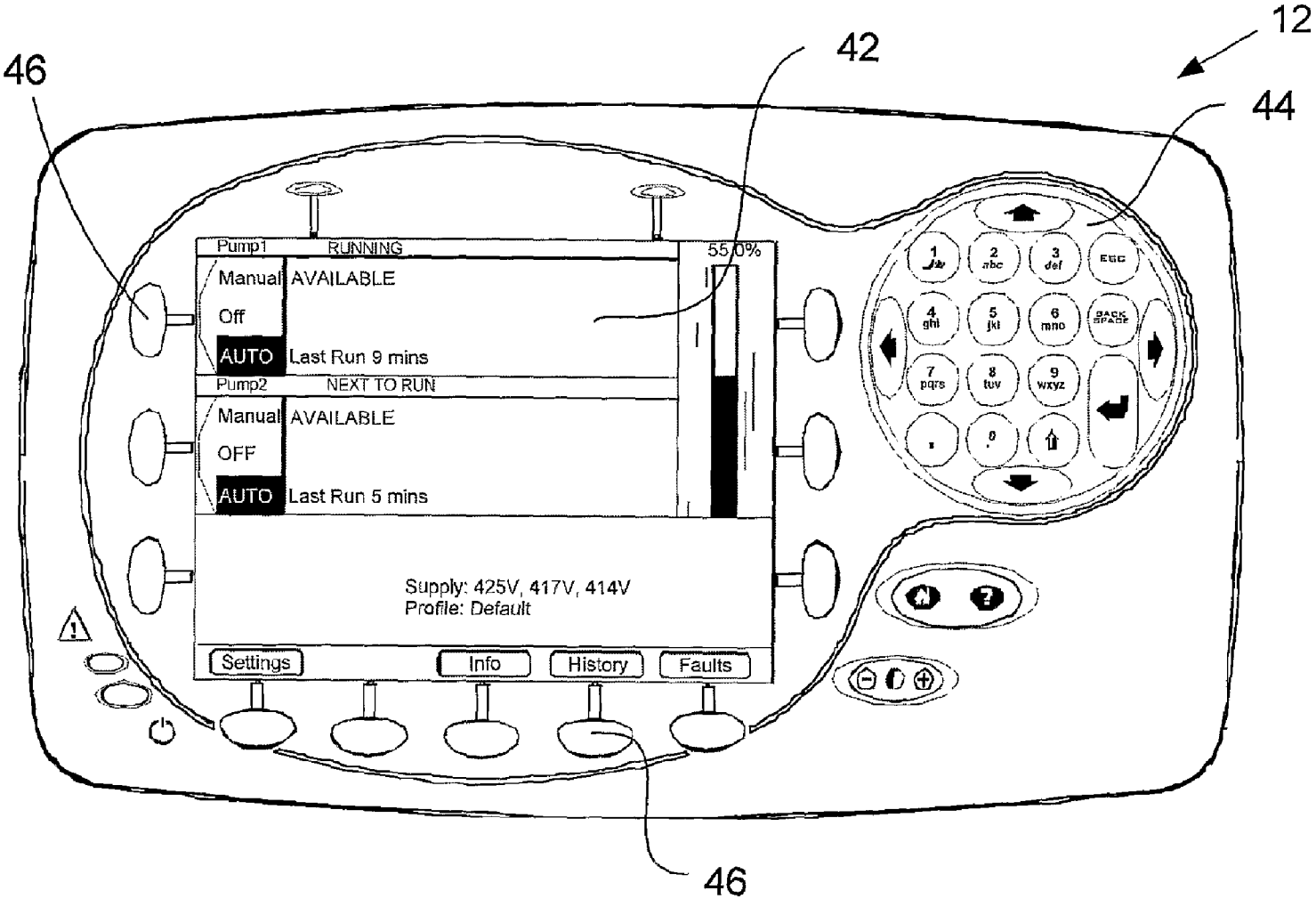
FIG. 4 is a front view of a user interface of the pumping station of FIG. 2*a;*

Referring to FIG. 4, the user interface 12 includes a display 42 for displaying pump station data from the controller 14, and a keypad 44 for a user to input data to be sent to the controller 14. The user interface further includes a plurality of peripheral selection buttons 46 surrounding the display 42 by which the user can select displayed data to be sent to the controller 14. The data displayed on the display 42 can change over time, and displayed data is selected by pressing the button 46 which is located in register with the data at the time. The user can initiate control functions including stopping and starting pumps, or resetting faults using the selection buttons 46.

Figure 5:
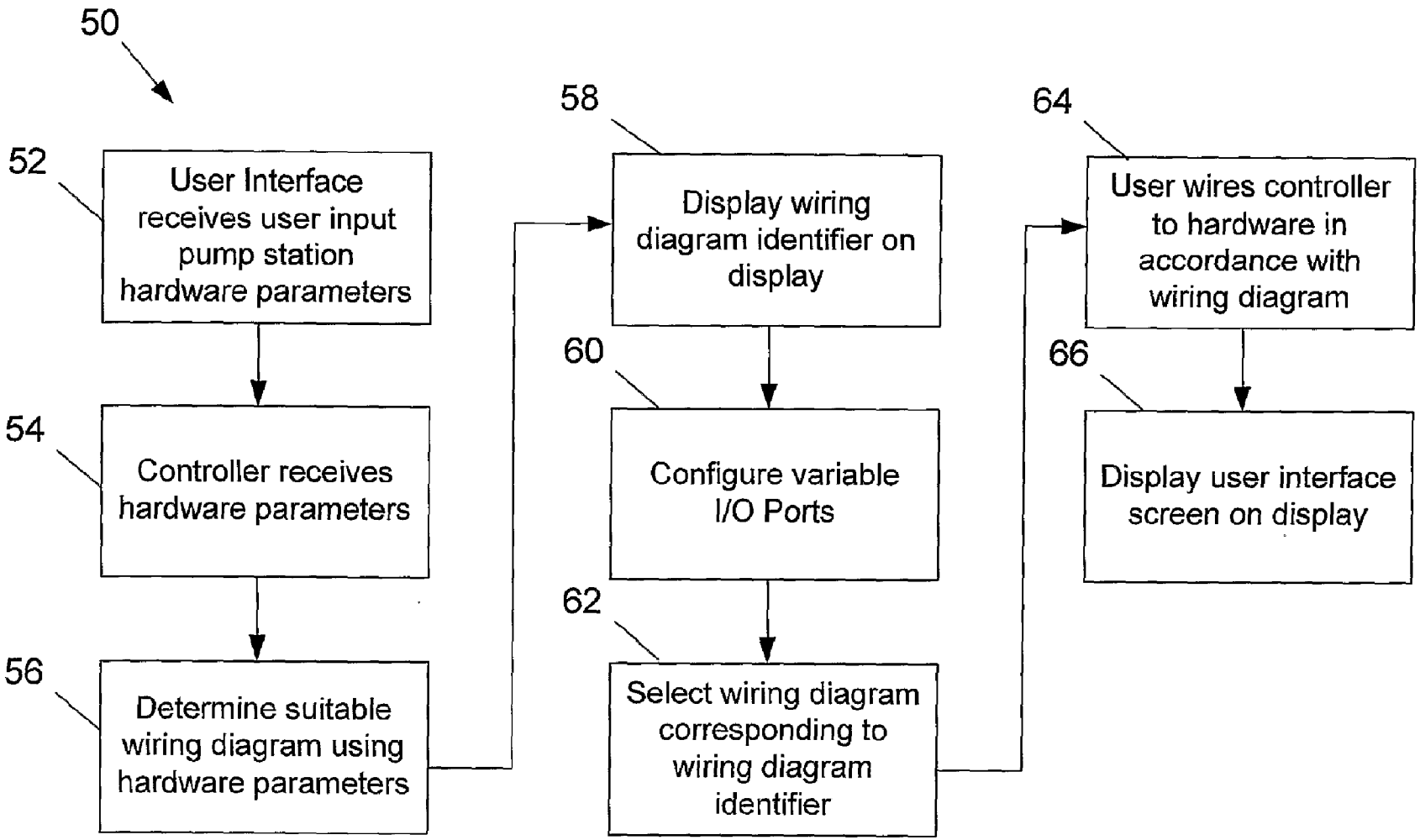
FIG. 5 is a flowchart of a method for determining a coupling configuration between a pumping station controller and pumping station hardware in accordance with the embodiment.

The user can execute the configuration software 28 on the controller 14 when setting up a pump station 2. The configuration software 28 includes instructions for the microprocessor 19, and hence the controller 14, to perform the pump station wiring configuration method 50 as described in detail below with reference to FIG. 5. An authorization procedure may be conducted using a username and password, before the user can initiate the method 50.

At element 52, the user interface 14 receives user inputs or user selected criteria parameters. The criteria parameters relate to the hardware to be used when setting up the pumping station 2 and may include, for example, the number of pumps 10 of the pumping station (e.g. 2) and the type of liquid level sensor to be used in sensing the liquid level of the pumping station (e.g. digital). The user interface 14 sends the criteria parameters to the controller 14.

At element 54, the controller 14 receives the criteria parameters relating to the pumping station hardware.

At element 56, the controller 14 determines a suitable wiring configuration between the controller 14 and the pumping station hardware using the received criteria parameters. The criteria parameters (e.g. number of pumps=2, liquid level sensor type=digital) which were input by the user are corresponded to record parameters 38*a*, 38*b* of the record 28*a* stored within the database 32 (and no other record). The wiring diagram 40*a* (see FIG. 6*a*) which corresponds to the wiring diagram identifier 36 (i.e. WD A) of the record 28*a* is thereby decided upon as providing a suitable wiring configuration for coupling the controller 14 to the pumping station hardware to be used.

At element 58, the user interface 12 displays the wiring diagram identifier 36 of the record 28*a* on the display 42.

Figure 6A:
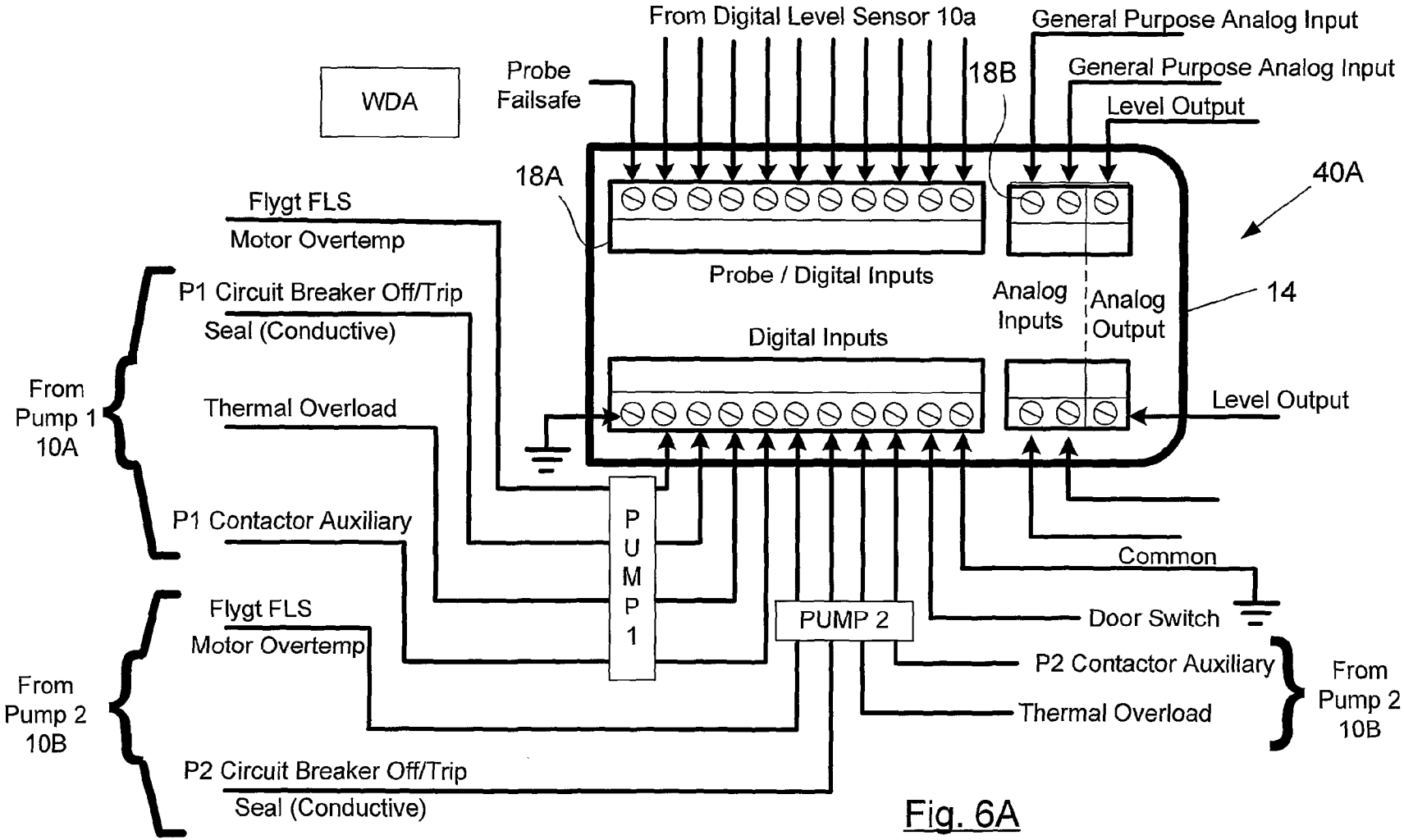
FIG. 6*a* is a first possible wiring diagram for the pumping station of FIG. 2*a*.
Figure 6B:
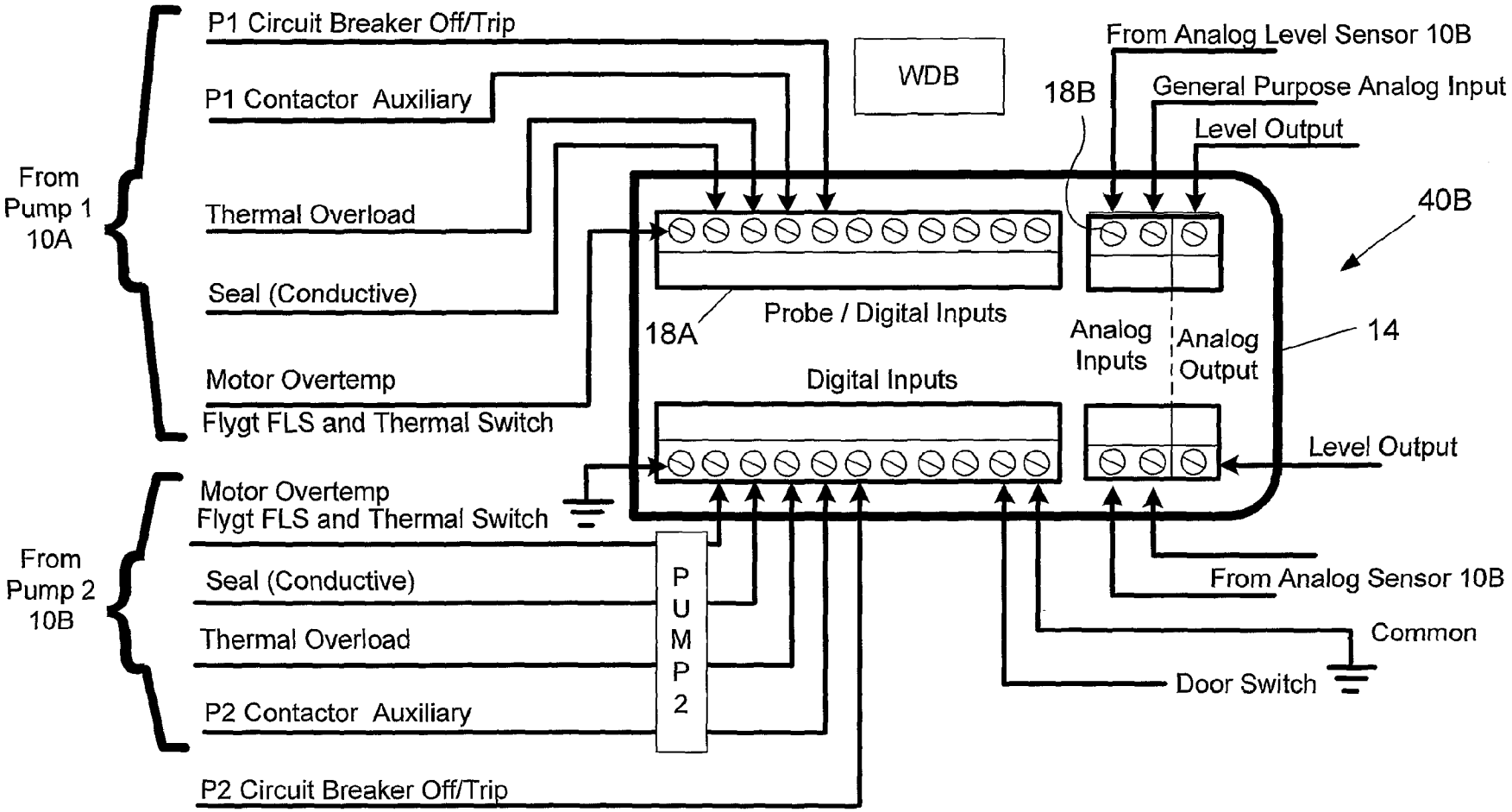
FIG. 6*b* is a second possible wiring diagram for the pumping station of FIG. 2*a.*

At element 60, the configuration software 28 may configure one or more of the variable I/O ports 18 of the controller 14 in accordance with the criteria parameters (and the wiring diagram 40*a* decided upon in element 56). In this manner, the configuration software 28 can initialize variables (or constants) in the software interface block 26 so that like referenced variables in the control routines 24 are linked with the required variable I/O ports 18. For example, if a digital level sensor 8*a* is to be used, the control routines 24 using input level sensor data would be linked with a digital I/O port 18*a* (FIG. 6*a*). Alternatively, if an analog level sensor 8*a* is to be used, the control routines 24 using input level sensor data would instead be linked with an analog I/O port 18*b* (FIG. 6*b*).

At element 62, the user refers to a manual of wiring diagrams and selects the wiring diagram 40*a* shown in FIG. 6*a* which corresponds to the determined wiring diagram indicator 36 (e.g. WD A). The wiring diagram 40*a* shows the wiring connections required between the variable I/O ports 18 of the controller 14 and the hardware (i.e. pumps 10*a*, 10*b* and digital level sensor 18*a*) which meets the criteria parameters (e.g. number of pumps=2, liquid level sensor type=digital).

At element 64, the user wires the controller 14 to the pumping station hardware (e.g. pumps 10*a*, 10*b*, level sensor 8*a*, etc.) in accordance with the selected wiring diagram 40*a* shown in FIG. 6*a*. The hardware is thereby wired to the variable I/O ports 18 of the controller 14 as required. At element 66, the display 42 of the user interface 12 displays a user interface screen. The user interface screen includes control options for controlling the mode of operation of each pump 10 (e.g. manual, off, auto), the number of pumps 38*a* of the record 28*a*, the type of level sensor 38*b* of the record 28*a*, and fault settings relating to pump seal faults and thermal faults for example. The user may select and toggle various control options using the selection buttons 46.

The foregoing method 50 of deciding upon a suitable wiring diagram using the criteria parameters provides a systematic and repeatable technique for facilitating coupling of the controller 14 to the pumping station hardware. Accordingly, any pumping stations 2 having the same hardware and associated criteria parameters will also have the same determined wiring diagram 40, and will be wired in the same manner. This will enable users to readily reconfigure pumping stations 2 as they are familiar with the wiring configuration, and the wiring documentation is readily available in the form of a wiring diagram 40.

In addition, any upgrades or repairs to a pumping station involving the addition or replacement of hardware can be readily performed, by performing the method 50 and inputting the new hardware criteria parameters. Advantageously, the user need not have sophisticated programming skills to perform the method 50, such as those skills required by users that set up PLC based systems.

As previously mentioned, the software 20 would typically be provided on a media 21, such as a magnetic or optical disk or solid state memory, which contains computer readable instructions for execution by the controller 14 to thereby perform the preceding method 50.

A person skilled in the art will appreciate that many embodiments and variations can be made without departing from the ambit of the present invention.

In the configuration method 50 described in one embodiment, both the hardware wiring configuration and software interface configuration was performed at elements 64 and 60 respectively. In alternative embodiments, the software interface block 26 need not be configured as the software 20 can accommodate a number of different wiring configurations.

In one embodiment, the configuration software 28 for deciding upon a suitable wiring diagram 40 was loaded on and executed using the controller 14. In an alternative embodiment, the configuration software 28 can be loaded on and executed using a personal computer or other like processor which is separate from the controller 14.

In one embodiment, a plurality of criteria parameters relating to pumping station hardware was input by the user. In alternative embodiments a sole parameter may be inputted. In other embodiments, the hardware may include a leakage sensor of the pumps, a thermal sensor of the pumps or a remote terminal unit (RTU), and corresponding criteria parameters may also be inputted. Other criteria parameters which may be entered can include the number of wells in which pumps are located and the mode of discharge of the pumps (i.e. empty or fill the well).

In compliance with the statute, the invention has been described in language more or less specific to structural or methodical features. It is to be understood that the invention is not limited to specific features shown or described since the means herein described comprises illustrative forms of putting the invention into effect.

The invention claimed is:

1. A method for determining a future wiring configuration between a pumping station controller and pumping station hardware, the method comprising:

receiving in a processor at least one user input parameter relating to the pumping station hardware; and determining, with the processor, a wiring configuration for future wiring with wires of the pumping station controller to the pumping station hardware using the at least one user input parameter.

2. The method according to claim 1, comprising wiring the pumping station controller to the pumping station hardware in accordance with the determined wiring configuration.

3. The method according to claim 2, comprising wiring input/output (I/O) ports of the controller to the hardware.

4. The method according to claim 1, wherein the processor accesses a database comprising a plurality of wiring diagram records, each wiring diagram record comprising:

at least one unique record parameter relating to possible pumping station hardware; and a wiring diagram identifier for identifying a wiring diagram comprising the wiring configuration between the pumping station controller and the possible pumping station hardware.

5. The method according to claim 4, wherein the determining the wiring configuration comprises:

corresponding the at least one received parameter with the at least one record parameter; and displaying the wiring diagram identifier of the corresponding record.

6. The method according to claim 1 further comprising inputting or selecting the at least one user input parameter, prior to the receiving, using a user interface which is wired to the processor.

7. The method according to claim 1, wherein the processor comprises the controller.

8. The method according to claim 1, further comprising:

configuring one or more input/output (I/O) ports of the controller in accordance with the at least one user input parameter.

9. The method according to claim 8, wherein the configuring the ports comprises configuring a software interface linking control routines for controlling the hardware with the I/O ports.

10. The method according to claim 1, wherein the hardware comprises any one or more of the following devices:

a pump, a variable speed drive pump, a digital liquid level sensor, an analogue liquid level sensor, a leakage sensor of the pump, a thermal sensor of the pump, a remote terminal unit (RTU), communications devices comprising a modem or a radio transceiver, and digital or analog sensors comprising, pulsed rain gauges and liquid flow rate sensors.

11. The method according to claim 1, wherein the at least one parameter comprises any one or more of the following: the number of pumps of the pumping station, the type of liquid level sensor to be used in sensing the liquid level of the pumping station, and the type of leakage sensor of each pump.

12. A method for determining a future wiring configuration between a pumping station controller and pumping station hardware, the method comprising:

determining, with a processor, a wiring configuration for future wiring with wires of the pumping station controller to the pumping station hardware using at least one user input parameter relating to the pumping station hardware.

13. A system for determining a future wiring configuration between a pumping station controller and pumping station hardware, the system comprising a processor to determine a wiring configuration for future wiring with wires of the pumping station controller to the pumping station hardware using at least one user input parameter relating to the pumping station hardware.

14. A product comprising a computer usable medium containing computer readable instructions for execution by a processor to thereby perform operations for determining a future wiring configuration between a pumping station controller and pumping station hardware, the operations comprising determining, with the processor, a wiring configuration for future wiring with wires of the pumping station controller to the pumping station hardware using at least one user input parameter relating to the pumping station hardware.

15. A computational device arranged to determine a future wiring configuration between a pumping station controller and pumping station hardware, the computational device comprising a processor to determine a wiring configuration for future wiring with wires of the pumping station controller to the pumping station hardware using at least one user input parameter relating to the pumping station hardware.

16. A pump controller for monitoring pumping hardware of a well, comprising:

a user interface having a display screen and user input keys;

a processor in communication with the user interface and in communication with ports for wiring to the pumping hardware; and a memory in communication with the processor;

wherein the memory comprises a software product comprising:

a control software block comprising control routines for monitoring and controlling the pumping hardware;

a configuration software block arranged to variably interface the control routines to the communication ports in response to user input parameters specifying the pumping hardware; and instructions to display information to assist a user to wire the hardware to the ports in response to the user input parameters.

* * * * *